US009991062B2

(12) United States Patent
Zimmer

(10) Patent No.: US 9,991,062 B2
(45) Date of Patent: Jun. 5, 2018

(54) ELECTRICAL SWITCH DEVICE

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 224 days.

(21) Appl. No.: 15/000,182

(22) Filed: Jan. 19, 2016

(65) Prior Publication Data

US 2016/0211095 A1 Jul. 21, 2016

Related U.S. Application Data

(60) Provisional application No. 62/104,889, filed on Jan. 19, 2015.

(51) Int. Cl.

| | |
|---|---|
| ***H01H 13/70*** | (2006.01) |
| ***H01H 9/02*** | (2006.01) |
| ***F41C 27/00*** | (2006.01) |
| *H01R 27/02* | (2006.01) |
| *H01R 24/58* | (2011.01) |
| *F41G 11/00* | (2006.01) |
| *F41G 1/32* | (2006.01) |

(52) U.S. Cl.

CPC ..... *H01H 9/0235* (2013.01); *F41C 27/00* (2013.01); *F41G 1/32* (2013.01); *F41G 11/003* (2013.01); *H01R 24/58* (2013.01); *H01R 27/02* (2013.01)

(58) Field of Classification Search

CPC ..... F41G 1/35; H01H 9/0235; H01H 13/70
USPC ..... 42/146
See application file for complete search history.

(56) References Cited

U.S. PATENT DOCUMENTS

| | | | | |
|---|---|---|---|---|
| 7,273,292 | B2 | 9/2007 | Kim | |
| 7,332,682 | B2 | 2/2008 | Kim | |
| 7,674,003 | B2 | 3/2010 | Sharrah et al. | |
| 8,110,760 | B2 | 2/2012 | Sharrah et al. | |
| 8,360,598 | B2 | 1/2013 | Sharrah et al. | |
| 8,662,701 | B2 | 3/2014 | Sharrah et al. | |
| 2010/0031552 | A1* | 2/2010 | Houde-Walter | F41A 35/00 42/72 |
| 2010/0242332 | A1* | 9/2010 | Teetzel | F41A 23/08 42/72 |
| 2011/0261559 | A1 | 10/2011 | Couture et al. | |

(Continued)

OTHER PUBLICATIONS

Surefire, Remote Dual Switch for Weaponlight + ATPIAL Laser Device, 2013 [retreived on Jan. 6, 2015], Retrieved from online <http://www.surefire.com/remote-dual-switch-for-weaponlight-sr-d-it.html>, one page.

*Primary Examiner* — Jeffrey Shin
(74) *Attorney, Agent, or Firm* — Asgaard Patent Services, LLC; F. Wayne Thompson, Jr.

(57) ABSTRACT

Implementations of an electrical switch device are provided. In some implementations, the electrical switch device may be used to operate electrically powered firearm accessories (e.g., lasers and illumination tools). In some implementations, the electrical switch device may be conductively connected to a firearm accessory by a flexible cable having a connector thereon. In this way, the electrical switch device may be remotely positioned relative to the firearm accessory to which it is attached. In some implementations, the electrical switch device may be secured to a mounting interface (e.g., KeyMod or M-LOK® accessory mounting slots and/or a Picatinny rail) for firearm accessories. In some implementations, the electrical switch device may include user selectable programs that control the operation of connected firearm accessories.

17 Claims, 6 Drawing Sheets

(56) References Cited

U.S. PATENT DOCUMENTS

2012/0131840 A1* 5/2012 Toole ..... F41G 1/35
42/114
2014/0245650 A1* 9/2014 Abst ..... F41G 11/003
42/84

* cited by examiner

ELECTRICAL SWITCH DEVICE

CROSS REFERENCE TO RELATED APPLICATION

This application claims the benefit of U.S. Patent Application Ser. No. 62/104,889, which was filed on Jan. 19, 2015, and is incorporated herein by reference in its entirety.

TECHNICAL FIELD

This disclosure relates to implementations of an electrical switch device for use with electrically powered firearm accessories.

BACKGROUND

Switch operated electrical accessories (e.g., lasers and illumination tools) have been adapted for being secured to firearms. Electrical accessories are frequently positioned on a firearm to be parallel with, and close to the barrel of the firearm. In general, a mount is used with the electrical accessory to releasably secure it to a mounting interface (e.g., a Picatinny rail) secured to the firearm. Accessory mounts and mounting interfaces are well known in the art pertaining to firearms.

A variety of switch apparatuses are available to operate firearm mounted electrical switch devices, including tail cap switches and plug-in remote switches with "constant on" and "momentary on" capabilities. User preference and tactical considerations often direct both the positioning and selection of a particular switch type.

SUMMARY OF THE INVENTION

Implementations of an electrical switch device are provided. In some implementations, the electrical switch device may be used to operate electrically powered firearm accessories (e.g., lasers and illumination tools). In some implementations, the electrical switch device may be conductively connected to a firearm accessory by a flexible cable having a connector thereon. In this way, the electrical switch device may be remotely positioned relative to the firearm accessory to which it is attached. In some implementations, the electrical switch device may be secured to a mounting interface (e.g., KeyMod or M-LOK® accessory mounting slots and/or a Picatinny rail) for firearm accessories. In some implementations, the electrical switch device may include user selectable programs that control the operation of connected firearm accessories.

DETAILED DESCRIPTION

Figure 1:
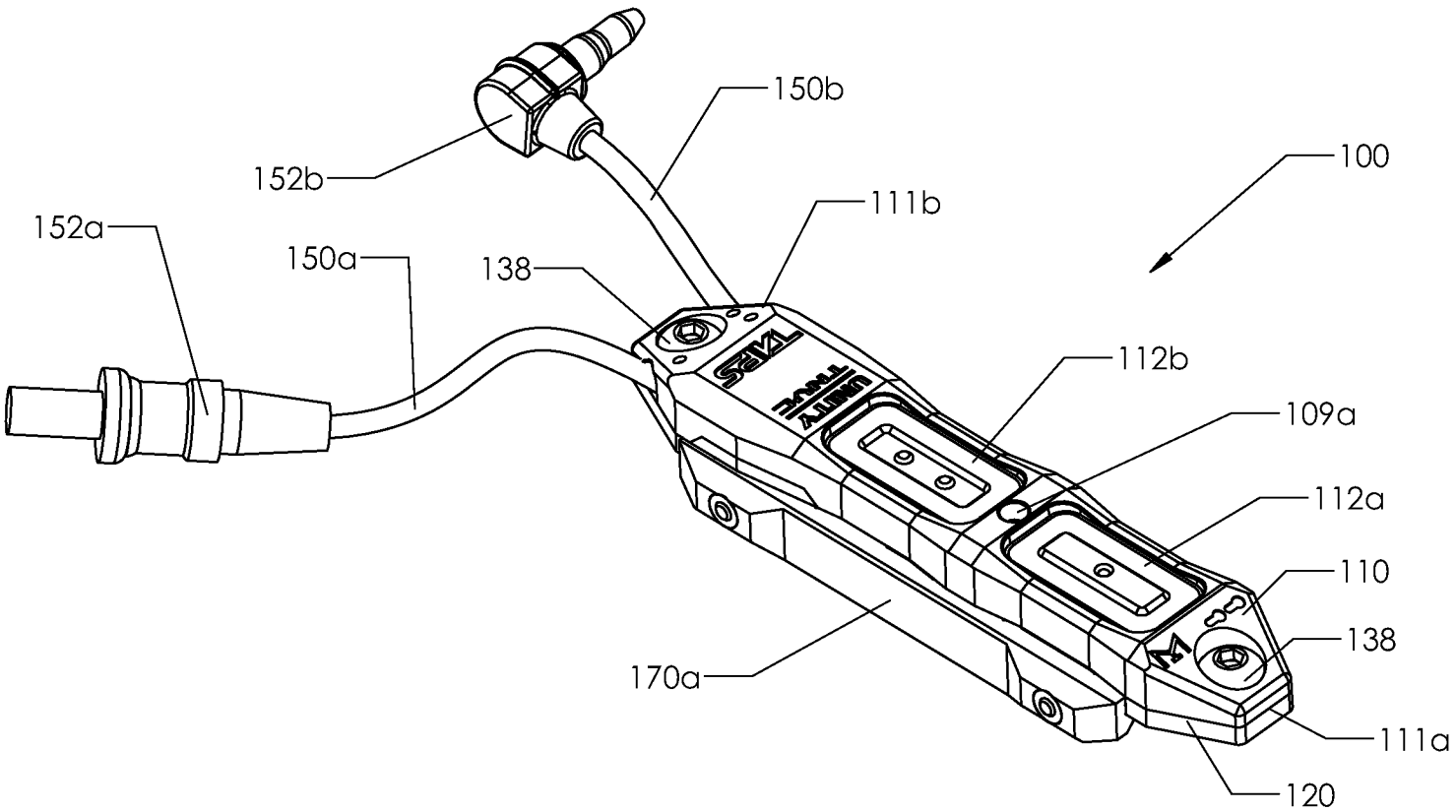
FIG. 1 illustrates an example implementation of the electrical switch device according to the principles of the present disclosure.
Figure 2A:
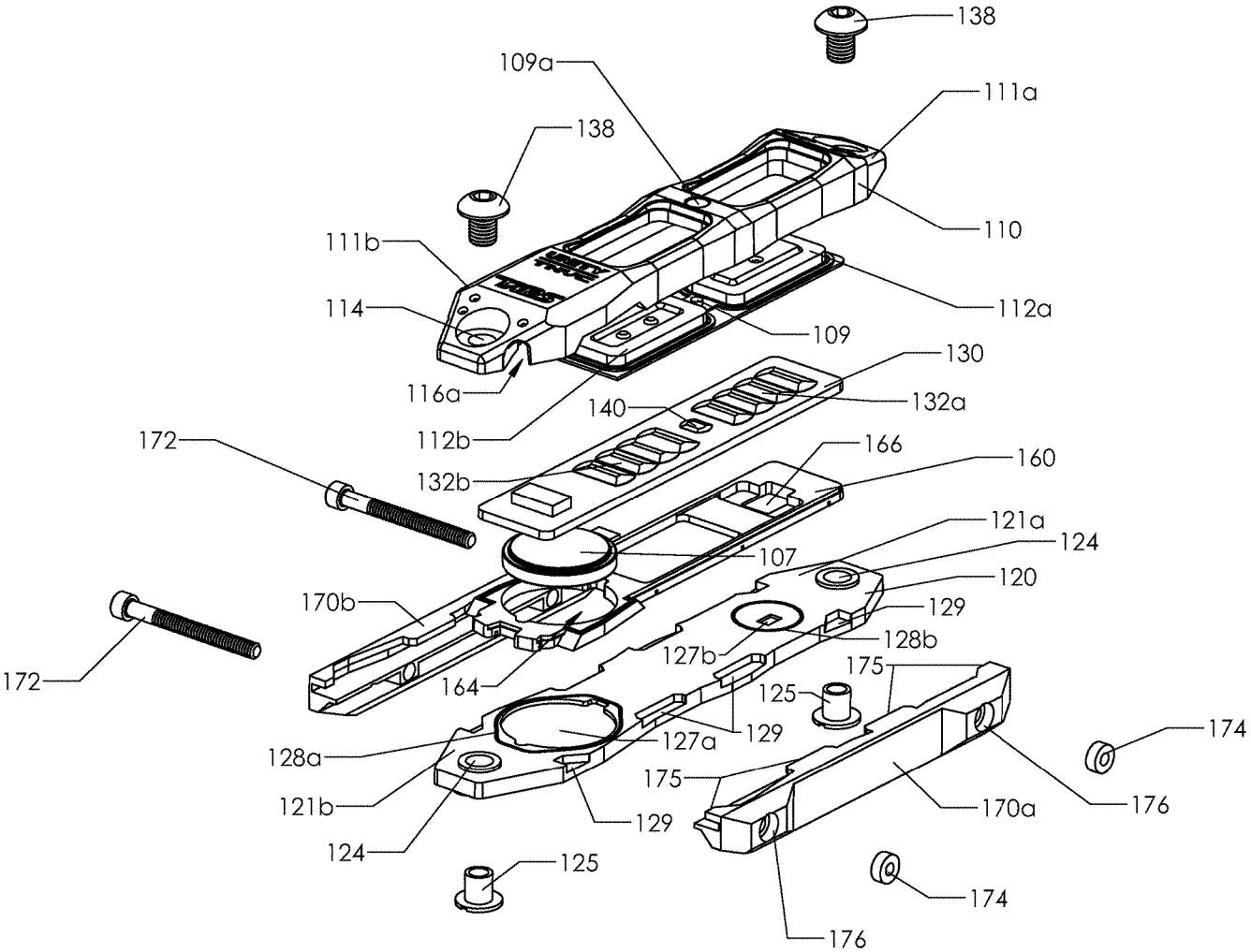
FIGS. 2A and 2B illustrate exploded views of the electrical switch device shown in FIG. 1.
Figure 2B:
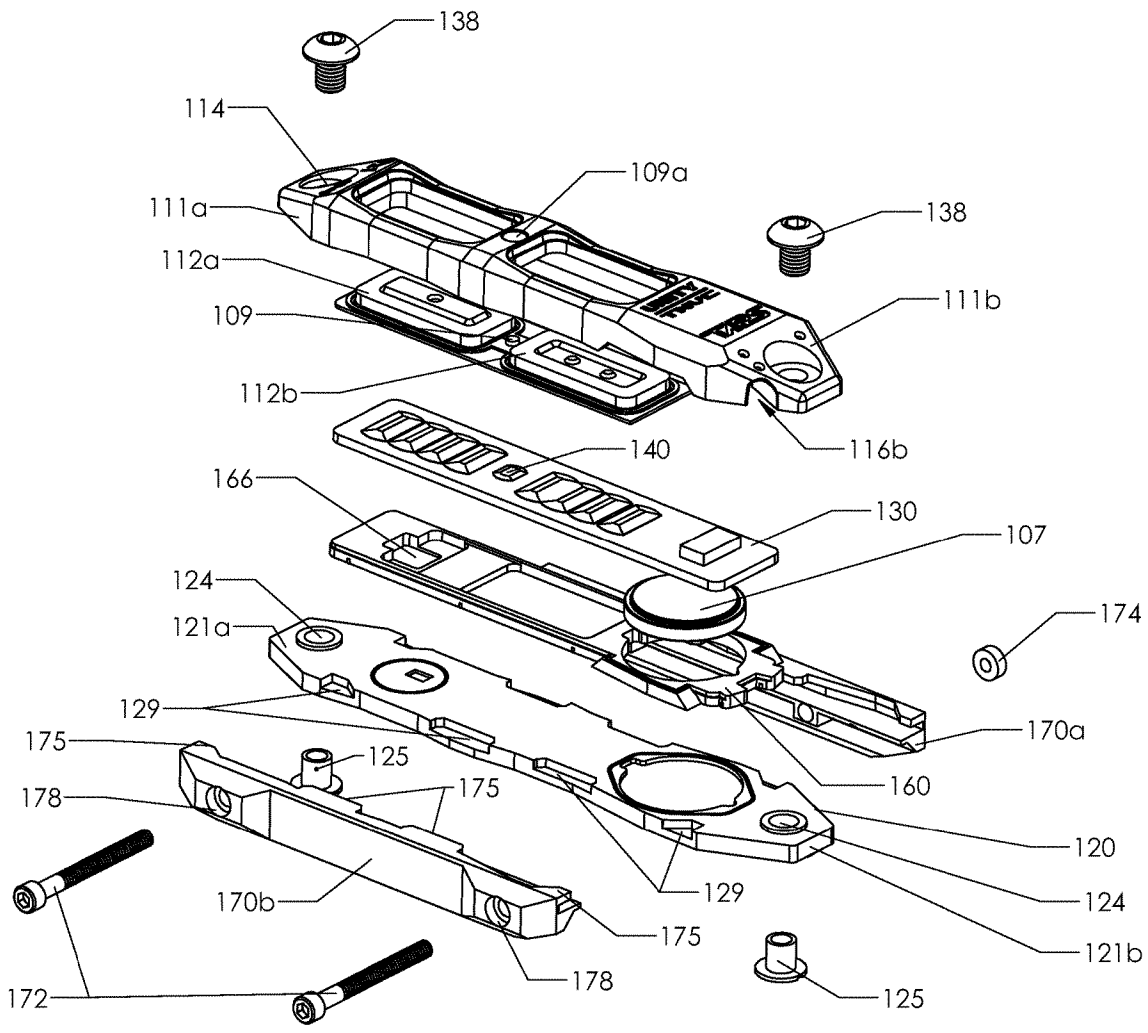

FIGS. 1 and 2A-2B illustrate an electrical switch device 100 according to the present disclosure. In some implementations, the electrical switch device 100 may be used to operate electrically powered firearm accessories (e.g., lasers and illumination tools). In some implementations, the electrical switch device 100 may be conductively connected to a firearm accessory by a flexible cable having a connector thereon. In this way, the electrical switch device 100 may be remotely positioned relative to the firearm accessory to which it is attached. In some implementations, the electrical switch device 100 may be secured to a mounting interface (e.g., KeyMod or M-LOK® accessory mounting slots and/or a Picatinny rail) for firearm accessories. In some implementations, the electrical switch device 100 may include user selectable programs that control the operation of connected firearm accessories.

Figure 3:
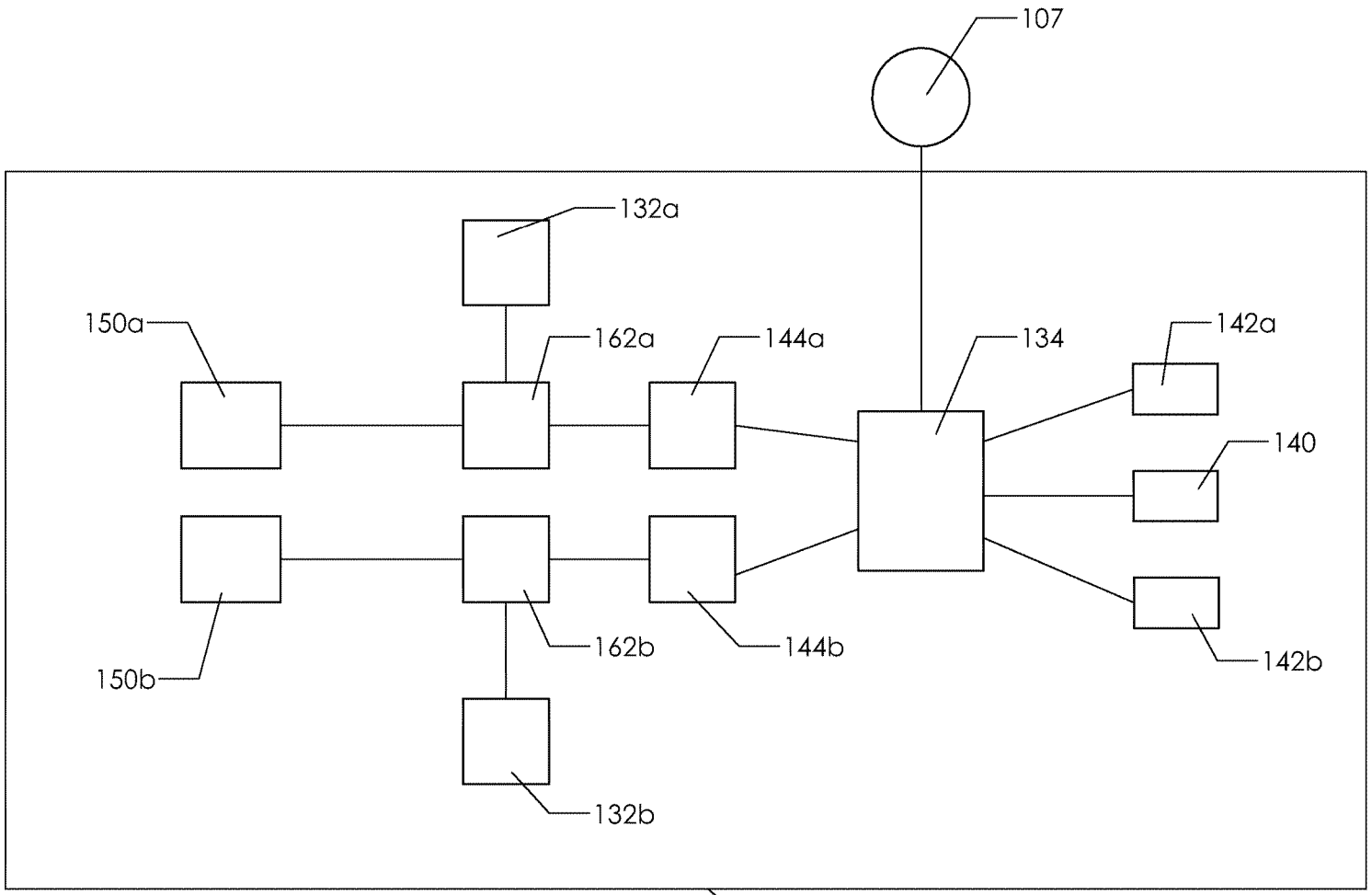
FIG. 3 illustrates an example schematic view of the electronic circuitry of the electrical switch device according to the present disclosure.

As shown in FIG. 1, in some implementations, the electrical switch device 100 may comprise a watertight housing 102 constructed to encase an electronic circuitry 105 (see, e.g., FIG. 3). In some implementations, the electronic circuitry may include a first cable 150*a* and a second cable 150*b* (collectively cables 150), a first activation switch 132*a* and a second activation switch 132*b* (collectively activation switches 132), and a first selection switch 162*a* and a second selection switch 162*b* (collectively selection switches 162).

As shown in FIGS. 2A and 2B, in some implementations, the housing 102 of the electrical switch device 100 may comprise a top body portion 110, a middle body portion 160, and a bottom body portion 120.

As shown in FIGS. 2A and 2B, in some implementations, the top body portion 110 may have the general shape of a rectangle. In some implementations, the top body portion 110 may have any shape suitable for use as part of the housing 102 of the electrical switch device 100.

As shown in FIGS. 2A and 2B, in some implementations, the top body portion 110 may have a first end 111*a* and a second end 111*b*. In some implementations, the second end 111*b* of the top body portion 110 may have a first opening 116*a* and a second opening 116*b* (collectively openings 116) extending therethrough. In some implementations, the openings 116 may have a semi-circular shape configured to fit about a portion of a cable 150 (see, e.g., FIGS. 1 and 2A-2B). In some implementations, each of the openings 116 may have any shape suitable for being secured about a portion of a cable 150 used to conductively connect the electrical switch device 100 to an electrically powered firearm accessory (see, e.g., FIG. 4). In some implementations, there may be more than two or less than two openings 116 for cables 150 extending through the top body portion 110 of the housing 102.

In some implementations, a gasket may be placed about the interior of each opening 116*a*, 116*b*. In this way, water may be prevented from entering the housing 102 through the openings 116 when the housing 102 is assembled. In some implementations, the gasket(s) may be manufactured from rubber. In some implementation, the gasket(s) may be manufactured from any suitable material.

As shown in FIGS. 1 and 2A, in some implementations, the top body portion 110 includes a program switch cover 109, a first switch cover 112*a*, and a second switch cover 112*b* (collectively switch covers 112).

As shown in FIG. 1, in some implementations, the program switch cover 109 is accessible through an opening 109*a* in the top body portion 110. In some implementations, the program switch cover 109 is recessed within the opening

109*a*. In this way, the program switch 140 may not be inadvertently activated. In some implementations, the opening 109*a* used to access the program switch cover 109 is positioned to be over the program switch 140 when the housing 102 is assembled.

As shown in FIG. 1, in some implementations, each switch cover 112*a*, 112*b* is accessible through two openings extending through a top side of the top body portion 110. In some implementations, the openings used to access the first switch cover 112*a* and the second switch cover 112*b* are positioned to be over the first activation switch 132*a* and the second activation switch 132*b*, respectively, when the housing 102 is assembled.

As shown in FIG. 2A, in some implementations, each switch cover 112 may have the general shape of a rectangle. In some implementations, each switch cover 112 may be any shape suitable for use with the housing 102 of the electrical switch device 100. In some implementations, the switch covers 112 may be molded into the top body portion 110 of the housing 102.

In some implementations, the program switch cover 109, the first switch cover 112*a*, and the second switch cover 112*b* may be configured to serve as gaskets and thereby prevent water from entering the housing 102 through their respective openings. In some implementations, the program switch cover 109 and the switch covers 112 may be manufactured from a rubber material. In some implementations, the program switch cover 109 and the switch covers 112 may be manufactured from a flexible synthetic material. In some implementations, the program switch cover 109 and the switch covers 112 may be manufactured from any suitable material.

As shown in FIGS. 2A and 2B, in some implementations, there may be a bore 114 extending through the first end 111*a* and the second end 111*b* of the top body portion 110. In some implementations, each bore 114 may be configured to receive a threaded fastener 138 therein (see, e.g., FIG. 1). In this way, the top body portion 110 may be secured to the bottom body portion 120 of the housing 102 (discussed in further detail below).

As shown in FIG. 2A, in some implementations, the middle body portion 160 is configured to fit between the top body portion 110 and the bottom body portion 120. In some implementations, the middle body portion 160 may be used to secure the PCB 130 to the top body portion 110 of the electrical switch device 100. In some implementations, the middle body portion 160 may be configured to lock to the top body portion 110. In some implementations, the middle body portion 160 includes a bore 164 therethrough configured to receive the power source 107 and an opening(s) 166.

As shown in FIG. 2A, in some implementations, the opening 166 extends through the middle body portion 160. In some implementations, the first selection switch 162*a* and the second selection switch 162*b* may extend from a bottom side of the PCB 130 through the opening 166 in the middle body portion 160. In this way, selection switches 162 may be accessed and toggled when a user removes the bottom body portion 120 from the top body portion 110 of the housing 102.

As shown in FIG. 2A, in some implementations, the bottom body portion 120 may have the general shape of rectangle. In some implementations, the bottom body portion 120 may have any shape suitable for use as part of the housing 102 of the electrical switch device 100.

As shown in FIG. 2A, in some implementations, there may be a first recess 127*a* in the interior side of the bottom body portion 120 configured to receive a portion of the power source 107 (e.g., one or more batteries) therein. In some implementations, an o-ring 128*a* may be nested within the bottom body portion 120 and positioned to form a perimeter around the first recess 127*a* (see, e.g., FIG. 2A). In this way, water and other liquids may be prevented from seeping around the power source 107 and into the housing 102.

As shown in FIG. 2A, in some implementations, there may be a second recess 127*b* in the interior side of the bottom body portion 120 configured to receive therein a portion of the selection switches 162 extending from the PCB 130 through the middle body portion 160. In some implementations, an o-ring 128*b* may be nested within the bottom body portion 120 and positioned to form a perimeter around the second recess 127*b* (see, e.g., FIG. 2A). In this way, water and other liquids may be prevented from seeping around the selection switches 162 and into the housing 102.

As shown in FIG. 2A, in some implementations, there may be a bore 124 extending through the first end 121*a* and a second end 121*b* of the bottom body portion 120. In some implementations, each bore 124 may be configured to receive therein a lug 125 or similar thread insert. In some implementations, each lug 125 may be configured to threadedly receive a portion of a threaded fastener 138 therein.

As shown in FIG. 2A, in some implementations, the PCB 130 may have the general shape of a rectangle. In some implementations, the PCB 130 may be any shape suitable for being positioned within the housing 102 of the electrical switch device 100. In some implementations, the PCB 130 may form a portion of the electronic circuitry 105 (see, e.g., FIG. 3). In some implementations, the PCB 130 may include thereon a logic board 134, a first solid state rely 144*a*, a second solid state relay 144*b*, the first selection switch 162*a*, the second selection switch 162*b*, the first activation switch 132*a*, the second activation switch 132*b*, the first cable 150*a*, the second cable 150*b*, a first program activation switch 142*a* and a second program activation switch 142*b* (collectively program activation switches 142), and the program switch 140 (see, e.g., FIG. 3).

Figure 4:
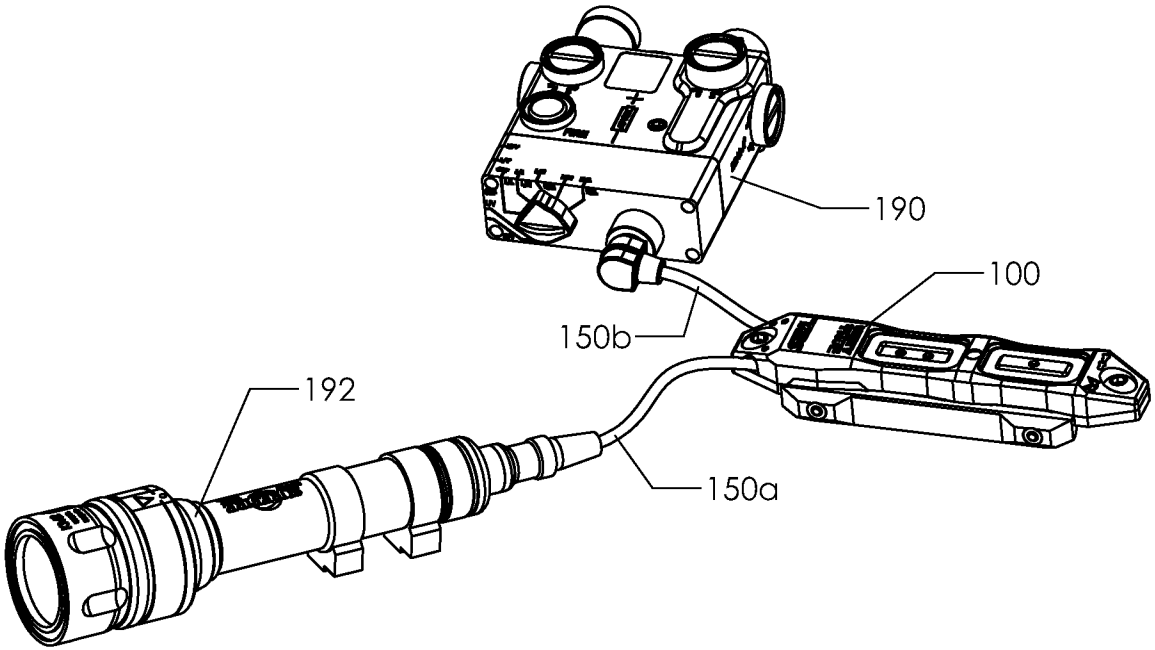
FIG. 4 illustrates the electrical switch device shown in FIG. 1 connected to two firearm accessories.

In some implementations, each cable 150 may include a connector 152*a*, 152*b* thereon configured to connect with an electrically powered firearm accessory (see, e.g., FIG. 4, elements 190 (a laser) and 192 (an illumination tool)).

In some implementations, the following steps may be taken to assemble the housing 102 of an electrical switch device 100 constructed in accordance with the present disclosure. Initially, the switch covers 112 and the program switch cover 109 may be positioned in the top body portion 110 as described above. Then, the PCB 130 is oriented and positioned so that the first cable 150*a* and the second cable 150*b* extend through the first opening 116*a* and the second opening 116*b*, respectively, of the top body portion 110 (see, e.g., FIG. 1). Next, the middle body portion 160 may be oriented so that the end with the bore 166 therethrough is positioned adjacent the second end 111*b* of the top body portion 110 (see, e.g., FIG. 2A). Then, the middle body portion 160 is secured to the underside of the top body portion 110. In this way, the PCB 130 may be held in position against the underside of the top body portion 110. Then, the bottom body portion 120 is positioned so that the bore 124 extending through the first end 121*a* and the second end 121 thereof is in alignment with the bore 114 extending through the first end 111*a* and the second end 111*b*, respectively, of the top body portion 110. Next, a fastener 138 in inserted through each bore 114 of the top body portion and threadedly secured to the lug 125 positioned in each bore 124 of the bottom body portion 120 (see, e.g., FIG. 1)

To disassemble the housing 102 of the electrical switch device 100, the above steps are performed in reverse.

To remove only the bottom body portion 120 from the top body portion 110, the fasteners 138 need only be removed from the lugs 125.

In some implementations, the lugs 125 described above may be replaced with lugs configured to interface with KeyMod and/or M-LOK® accessory mounting slots. In this way, the housing 102 of the electrical switch device 100 may be directly mounted to a mounting interface having KeyMod and/or M-LOK® accessory mounting slots.

As shown in FIG. 1, in some implementations, the housing 102 of the electrical switch device 100 may be configured to secure to a Picatinny rail (also known as a MIL-STD 1913 rail). In some implementations, the housing 102 may be secured to a Picatinny rail through the use of a clamp 170 comprising a first longitudinal flange 170*a*, a second longitudinal flange 170*b*, two threaded fasteners 172, and two thread inserts 174 (see, e.g., FIG. 2B).

As shown in FIGS. 1 and 2A, in some implementations, each longitudinal flange 170*a*, 170*b* may be configured to interface with the bottom body portion 120 of the housing 102 and a Picatinny rail. In some implementations, a thread insert 174 may be secured within each bore 176 extending through the first longitudinal flange 170*a* (see, e.g., FIG. 2A). In some implementations, the second longitudinal flange 170*b* may include two bores 178 extending therethrough. In some implementations, recesses 129 in the first side and the second side of the bottom body portion 120 are formed to receive the protrusions 175 extending from the first longitudinal flange 170*a* and the second longitudinal flange 170*b*, respectively (see, e.g., FIGS. 2A and 2B). In this way, the longitudinal flanges 170*a*, 170*b* may prevent the forward and rearward movement of the housing 102 when the clamp 170 has been used to secure it to a Picatinny rail.

To use the clamp 170 to secure the housing 102 to a Picatinny rail, in some implementations, the housing 102 may be initially placed against the Picatinny rail.

Then, the first longitudinal flange 170*a* may be oriented so that the protrusions 175 thereon will be received within the recesses 129 on the first side of the bottom body portion 120 (see, e.g., FIG. 2A). Next, the first longitudinal flange 170*a* is placed against the first side of the bottom body portion 120.

Then, the second longitudinal flange 170*b* may be oriented so that the protrusions 175 thereon will be received within the recesses 129 on the second side of the bottom body portion 120 (see, e.g., FIG. 2B). Next, the second longitudinal flange 170*a* is placed against the second side of the bottom body portion 120.

Then, a fastener may be inserted through each bore 178 in the second longitudinal flange 170*b*, through the space between the ribs (not shown but well known in the art) of the Picatinny rail, and threadedly secured to the thread inserts 174 of the first longitudinal flange 170*a* (see, e.g., FIG. 1).

In some implementations, the clamp 170 and/or the bottom body portion 120 may be configured to secure to any mounting interface for firearm accessories currently known or developed in the future.

As shown in FIG. 3, in some implementations, the electronic circuitry 105 may comprise a power source 107, such as one or more batteries, the logic board 134, the first solid state rely 144*a*, the second solid state relay 144*b*, the first selection switch 162*a*, the second selection switch 162*b*, the first activation switch 132*a*, the second activation switch 132*b*, the first cable 150*a*, the second cable 150*b*, the program switch 140, the first program activation switch 142*a*, and the second program activation switch 142*b*. In some implementations, the power source 107 is conductively connected to the PCB 130. Although not shown in the drawings, it will be understood that suitable wiring connects the electronic components of the electronic circuitry 105 in the housing 102.

As shown in FIG. 3, in some implementations, the first selection switch 162*a* and the second selection switch 162*b* may be conductively connected to the first activation switch 132*a* and the second activation switch 132*b*, respectively. In some implementations, the first selection switch 162*a* may be used to conductively connect the first activation switch 132*a* to the first cable 150*a* and/or the second cable 150*b*. In some implementations, the second selection switch 162*b* may be used to conductively connect the second activation switch 132*b* to the first cable 150*a* and/or the second cable 150*b*. If the electronic circuitry 105 loses power, through the use of the selection switches 162, the user may select which cable(s) 150 each activation switch 132 is conductively connected with. In some implementations, the selection switches 162 may be rotary and/or dip switches.

In some implementations, the activation switches 132 may be used for selectively closing a circuit thereby causing an attached electrically powered firearm accessory (e.g., a laser 190 or an illumination tool 192) to be energized by its internal power source. In some implementations, the first activation switch 132*a* and/or the second activation switch 132*b* may be constructed to operate as a pressure actuable "MOMENTARY ON" switch. In some implementations, the first activation switch 132*a* and/or the second activation switch 132*b* may be constructed to operate as a pushbutton actuable "CONSTANT ON/OFF" and "MOMENTARY ON" switch. In some implementations, the first activation switch 132*a* and/or the second activation switch 132*b* may be configured to provide tactile feedback during use. In some implementations, the activation switches 132 may be utilized even when the electronic circuitry 105 is not electrically powered (i.e. the power source 107 is dead). In some implementations, each activation switch 132 may be a dome switch.

In some implementations, the first activation switch 132*a* is co-mounted on the PCB 130 with the first program activation switch 142*a* and the second activation switch 132*b* is co-mounted on the PCB 130 with the second program activation switch 142*b*. In some implementations, the co-mounted first activation switch 132*a* and first program activation switch 142*a* are positioned on the PCB 130 so that both are located under the first switch cover 112*a* when the housing 102 is assembled. In this way, when the user depresses the first switch cover 112*a* both switches 132*a*, 142*a* are engaged. In some implementations, the co-mounted second activation switch 132*b* and second program activation switch 142*b* are positioned on the PCB 130 so that both are located under the second switch cover 112*b* when the housing 102 is assembled. In this way, when the user depresses the second switch cover 112*b* both switches 132*b*, 142*b* are engaged.

As shown in FIG. 3, in some implementations, the first program activation switch 142*a* and the second program activation switch 162*b* may be operationally connected to the logic board 134. In some implementations, the logic board 134 may operationally connect the first program activation switch 142*a* with the first cable 150*b* and/or the second cable 150*b*. In some implementations, the logic board 134 operationally connects the second program activation switch 142*b* with the first cable 150*b* and/or the second cable 150*b*. In some implementations, each program activation switch 142*a*, 142*b* may be individually associated with one or more programs stored in the memory of the logic board 134. In this way, when a program activation switch 142*a*, 142*b* is pressed the program associated therewith will set the mode of operation for the one or more firearm accessories operationally connected thereto.

In some implementations, one or more programs may be stored in the memory of the logic board 134. In some implementations, one or more programs may be created by the user and stored in the memory of the logic board 134. In some implementations, a program may be used to set the mode of operation (e.g., momentary on, constant on, strobe activation, or a combination thereof) for the electrically powered firearm accessories conductively connected to the electrical switch device 100 via the cables 150. In some implementations, through the use of a program, how a program activation switch 142*a*, 142*b* is pressed (e.g., length of time and/or number of times) may dictate the mode of operation for any conductively connected electrically powered firearm accessories operationally connected thereto. In some implementations, a program may be used to place all or a portion (e.g., the logic board 134) of the electronic circuitry 105 of the electrical switch device 100 into sleep mode (or auto shutdown mode) after a preset period of time has lapsed (e.g., one hour, five minutes, 10 minutes, etc . . . ). In this way, the life of the power source 107 may be preserved. In some implementations, the program switch 140 may be used to initiate the creation of a program and/or the selection of a program stored in the memory of the logic board 134 (discussed in greater detail below). One of ordinary skill in the art having the benefit of the present disclosure would know how to construct a logic board 134 for use with the electrical switch device 100.

Additional example programs stored in the memory of the logic board 134 and the mode(s) of operation provided thereby are as follows:

In some implementations, pressing one of the two program activation switches 142 may momentarily energize the one or more operationally connected electrically powered firearm accessories. In this implementation, once pressure is released from the program activation switch 142 the one or more firearm accessories are turned off.

In some implementations, pressing and releasing one of the two program activation switches 142 may continuously energize (constant on) the one or more operationally connected electrically powered firearm accessories. In this implementation, the one or more firearm accessories remain energized until the program activation switch 142 is pressed and released a second time.

In some implementations, holding a program activation switch 142 down momentarily energizes the operationally connected electrically powered firearm accessories. In this implementation, pressing and releasing (i.e., tapping) the program activation switch 142 twice in a row may continuously energize the one or more conductively connected electrically powered firearm accessories.

In some implementations, a program may operationally connect the first program activation switch 142*a* with both the first cable 150*a* and the second cable 150*b*. In this way, firearm accessories connected to the electrical switch device 100 via the cables 150*a*, 150*b* will simultaneously activate when the first program activation switch 142*a* is actuated.

In some implementations, a program can be used to place the second program activation switch 142*b* into circuit with both the first cable 150*a* and the second cable 150*b*. In this way, firearm accessories connected to the electrical switch device 100 via the cables 150*a*, 150*b* will simultaneously activate when the second program activation switch 142*b* is actuated.

The above modes of operation provided by the programs stored in the memory of the logic board 134 are for example only and are not intended to limit the scope of the invention thereto.

The following programming routine is provided as an example and should not be construed as a limitation on the scope of the present disclosure. The example programming routine may be used to create and store a program in the non-volatile memory of the logic board 134 and thereby associate one or more modes of operation with a program activation switch 142*a*, 142*b* and/or the electrical circuit 105 as a whole.

Step 1: Press program button 140. Both firearm accessories attached to the electrical switch device 100 flash three times simultaneously thereby indicating that the programming routine mode has been initiated.

The electronic circuitry 105 will reset to factory condition if the program button 140 is depressed for more than 10 seconds. When the reset is complete, both attached firearm accessories will flash five times.

The program selection mode ends if the program button 140 is depressed and no further action is taken within 60 seconds. Both attached firearm accessories will flash once, one after the other, thereby indicating that no program has been created or changed.

Step 2: Select Slave Mode (i.e. placing a program activation switch 142*a*, 142*b* into circuit with both cables 150). The attached firearm accessories will flash indicating the selection made (e.g., one flash "not slaved", two flashes "slaved").

Single press the first program activation switch 142*a*=Not Slaved.

Single press the second program activation switch 142*b*=Slaved.

Step 3: Select which program activation switch 142 is being programmed. Both firearm accessories will flash thereby indicating the selection made (e.g., one flash for the first program activation switch 142*a* and two flashes for the second program activation switch 142*b*).

Single press the first program activation switch 142*a*=first program activation switch 142*a* is being programmed.

Single press the second program activation switch 142*b*=second program activation switch 142*b* is being programmed.

Step 4: Select the mode of operation for the switch 142*a*, 142*b* selected during the previous step. Both firearm accessories flash the mode of operation selected (e.g., one flash=Momentary On, two flashes=Constant On, three flashes=double tap the switch for Constant On, and four flashes=hold switch down for Momentary On).

Single press first program activation switch 142*a*=Momentary On.

Double press first program activation switch 142*a*=Constant On.

Single press second program activation switch 142*b*=Double tap the switch for Constant On.

Double press second program activation switch 142*b*=Hold switch down for Momentary On.

Step 5: Select Auto Shutdown Mode delay for the electronic circuitry 105. Both firearm accessories flash the selection (one flash=one hour, two flashes=5 min, three flashes=10 min).

Single press first program activation switch 142*a*=one Hour.

Single press second program activation switch 142*b*=5 Min.

Double press first program activation switch 142*a*=10 Min.

In some implementations, the logic board 134 may be preset to Auto Shutdown the electronic circuitry 105 after one hour.

Step 6: The Program is now stored in the non-volatile memory of the logic board 134 thereby ending the programming routine. Upon ending the programming routine the attached firearm accessories (see, e.g., FIG. 4, elements 190 and 192) will both flash five times to indicate that program creation was a success.

In some implementations, the top body portion 110, the middle body portion 160, and/or the bottom body portion 120, may manufactured from a polymer. In some implementations, the top body portion 110, the middle body portion 160, and/or the bottom body portion 120 may manufactured from an aluminum alloy. In some implementations, top body portion 110, the middle body portion 160, and/or the bottom body portion 120 may be manufactured from any suitable material.

Figure 5:
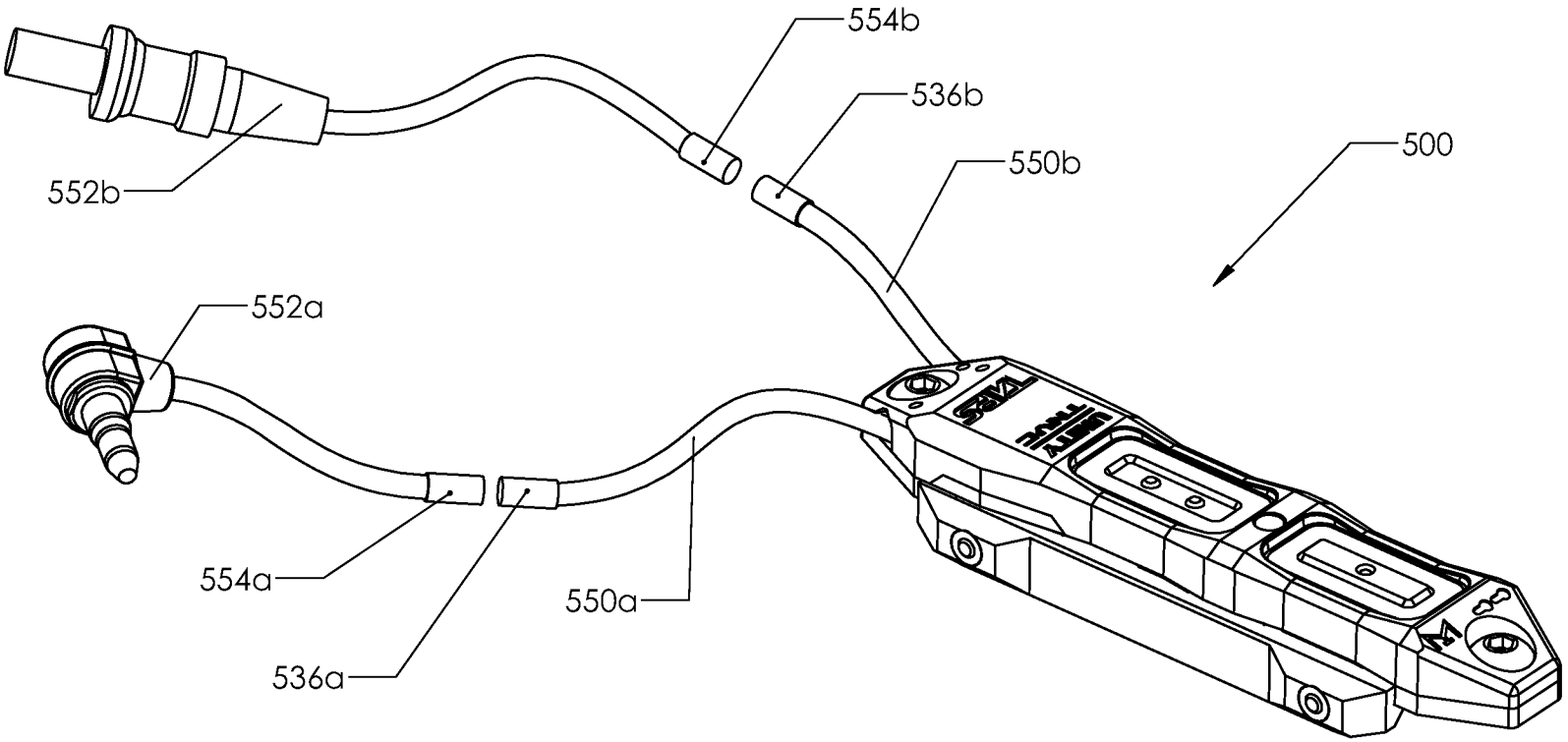
FIG. 5 illustrates another example implementation of the electrical switch device according to the principles of the present disclosure.

FIG. 5 illustrates another example electrical switch device 500. The electrical switch device 500 is similar to the electrical switch device 100 discussed above but includes a first cable 550*a* having a detachable connector 552*a* thereon and a second cable 550 having a detachable connector 552*b* thereon. In this way, by changing the connector 552 attached to a cable 550 the user may select the electrically powered firearm accessory each cable 550 is configured to connect with.

As shown in FIG. 5, in some implementations, there may be a first jack 536*a* and a second jack 536*b* on the end of the first cable 550*a* and the second cable 550*b*, respectively. In some implementations, there may be a first plug 554*a* and a second plug 554*b* on one end of the first connector 552*a* and the second connector 552*b*, respectively. In some implementations, the jack 536 on each cable 550 is configured to receive therein the plug 554 of each connector 552. Selecting the appropriate jack 536 and plug combinations 554 for use with the electrical switch device 500 would be known to one of ordinary skill in the art.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A switch device for use with electrically powered firearm accessories, the switch device comprising:

a housing having the shape of an elongated rectangle, the housing is configured to engage a mounting interface for firearm accessories and includes a first flexible switch cover and a second flexible switch cover that are in-line, the housing encases an electronic circuit, the electronic circuit comprising a first selection switch and a second selection switch, a first activation switch and a second activation switch that are in-line, and a first cable and a second cable;

wherein the first flexible switch cover is positioned over the first activation switch of the electronic circuit and the second flexible switch cover is positioned over the second activation switch of the electronic circuit;

wherein both the first cable and the second cable extend from a first end of the housing and include a connector thereon configured to connect with an electrically powered firearm accessory; and wherein the first selection switch and the second selection switch are conductively connected to the first activation switch and the second activation switch, respectively, the first selection switch is configured to selectively place the first activation switch into circuit with the first cable or the second cable, and the second selection switch is configured to selectively place the second activation switch into circuit with the first cable or the second cable.

2. The switch device of claim 1, wherein the first selection switch is configured to selectively place the first activation switch into circuit with both the first cable and the second cable, and the second selection switch is configured to selectively place the second activation switch into circuit with both the first cable and the second cable.

3. The switch device of claim 2, wherein the first activation switch and the second activation switch are each configured to provide MOMENTARY ON operation of a conductively connected electrically powered firearm accessory.

4. The switch device of claim 2, wherein the first activation switch and the second activation switch are configured to provide MOMENTARY ON operation and CONSTANT ON or OFF operation of a conductively connected electrically powered firearm accessory.

5. The switch device of claim 1, the electronic circuit further comprises a power source, a logic board, a first program activation switch and a second program activation switch; the first program activation switch is co-mounted with the first activation switch, the second program activation switch is co-mounted with the second activation switch; wherein the first program activation switch and the second program activation switch are operationally connected to the logic board, the logic board is configured to selectively place the first program activation switch into circuit with the first cable or the second cable, the logic board is also configured to selectively place the second program activation switch into circuit with the first cable or the second cable.

6. The switch device of claim 5, wherein the logic board is configured to selectively place the first program activation switch into circuit with both the first cable and the second cable, the logic board is also configured to selectively place the second program activation switch into circuit with both the first cable and the second cable.

7. The switch device of claim 6, wherein the first program activation switch in conjunction with the logic board are configured to provide MOMENTARY ON operation of a conductively connected electrically powered firearm accessory, the second program activation switch in conjunction with the logic board are configured to provide MOMENTARY ON operation of a conductively connected electrically powered firearm accessory.

8. The switch device of claim 6, wherein the first program activation switch in conjunction with the logic board are configured to provide MOMENTARY ON operation and CONSTANT ON or OFF operation of a conductively connected electrically powered firearm accessory; the second program activation switch in conjunction with the logic board are configured to provide MOMENTARY ON operation and CONSTANT ON or OFF operation of a conductively connected electrically powered firearm accessory.

9. The switch device of claim 6, wherein the logic board is configured to enter sleep mode due to inactivity after a preset amount of time has lapsed.

10. The switch device of claim 6, wherein the electronic circuitry further comprises a program switch; the logic board includes a non-volatile memory for storing one or more programs created during a programming routine, the programming routine is initiated by actuating the program button and is used to create one or more programs that set the mode of operation for any conductively connected electrically powered firearm accessories; the logic board is configured to associate at least a first program with the first program activation switch and a second program with the second program activation switch.

11. The switch device of claim 1, wherein the connector on the first cable is removably secured thereto and the connector on the second cable is removably secured thereto.

12. The switch device of claim 6, wherein the connector on the first cable is removably secured thereto and the connector on the second cable is removably secured thereto.

13. The switch device of claim 1, wherein the housing further comprises a top body portion and a bottom body portion, the top body portion is configured to be secured to the bottom body portion of the housing, and the bottom body portion is positioned directly adjacent to a mounting interface for firearm accessories when the housing is engaged therewith; the top body portion includes a first opening and a second opening that extend therethrough, the first flexible switch cover and the second flexible switch cover are accessible through the first opening and the second opening, respectively.

14. The switch device of claim 13, wherein the first cable and the second cable extend through a first opening and a second opening, respectively, in a first end of the top body portion of the housing.

15. The switch device of claim 13, wherein the first flexible switch cover and the second flexible switch cover of the housing are configured to serve as gaskets and thereby prevent water from entering the housing through their respective openings.

16. The switch device of claim 11, wherein the first cable and the second cable each include a jack on an end thereof, and each connector includes a plug on an end thereof; wherein the jack on the end of the first cable and the second cable is configured to interface with the plug on the end of each connector.

17. The switch device of claim 12, wherein the first cable and the second cable each include a jack on an end thereof; and each connector includes a plug on an end thereof; wherein the jack on the end of the first cable and the second cable is configured to interface with the plug on the end of each connector.

* * * * *